United States Patent [19]

Kriofske

[11] Patent Number: 4,719,658

[45] Date of Patent: Jan. 19, 1988

[54] HERMETICALLY SEALED ANCHOR CONSTRUCTION FOR USE IN POST TENSIONING TENDONS

[75] Inventor: Kris P. Kriofske, Dallas, Tex.

[73] Assignee: Special Personal and Financial Planning and Referral Services, Inc., Dallas, Tex.

[21] Appl. No.: 919,258

[22] Filed: Oct. 15, 1986

[51] Int. Cl.[4] ..... E04C 3/10

[52] U.S. Cl. ..... 52/223 L; 52/230

[58] Field of Search ..... 52/223 R, 223 L, 230

[56] References Cited

U.S. PATENT DOCUMENTS 4,561,226 12/1985 Tourneur ..... 52/223 L 4,616,458 10/1986 Davis et al. ..... 52/230

*Primary Examiner*—Carl D. Friedman

*Attorney, Agent, or Firm*—Jamison & McGregor

[57] ABSTRACT

For use with an anchor plate and tendon in a member made by casting and curing a protective hermetic sealant housing is disclosed. Briefly, the housing has a tray and cover enclosing the anchor plate. The tray and cover join together at frictionally engaged lips to receive hermetic sealing grease to prevent anchor plate or cable rust, corrosion, etc. The tray and cover join at adjacent peripheral lips holding the parts together.

13 Claims, 5 Drawing Figures

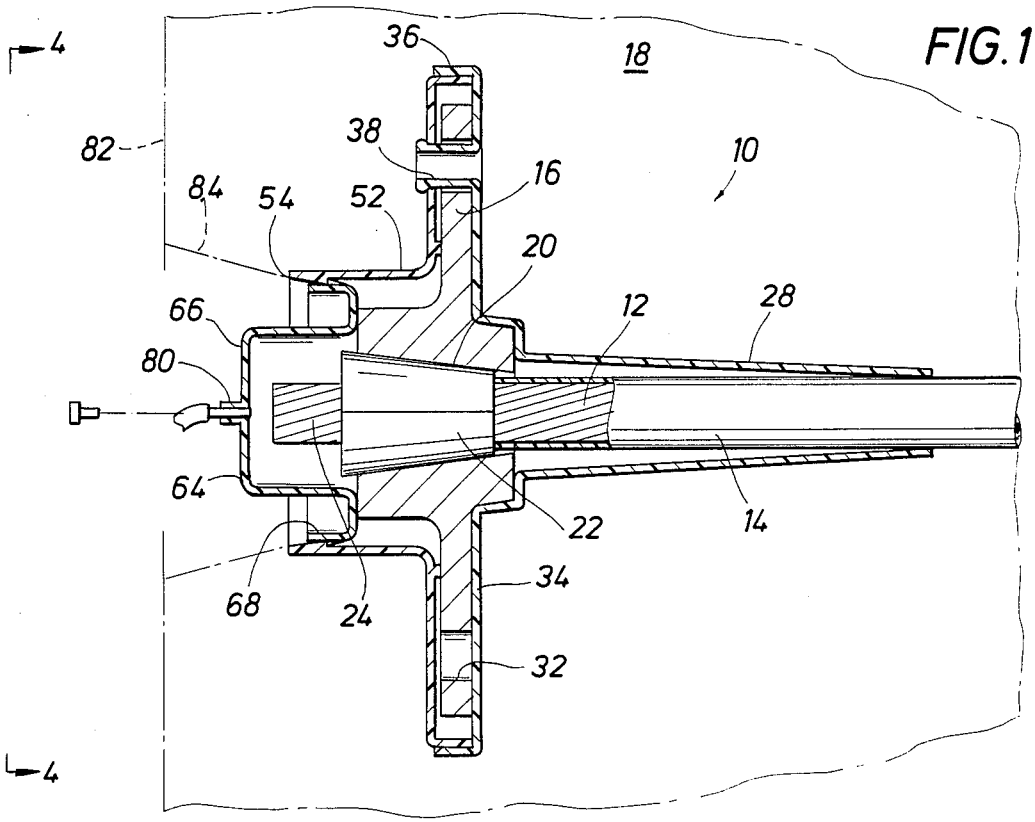
FIG. 1
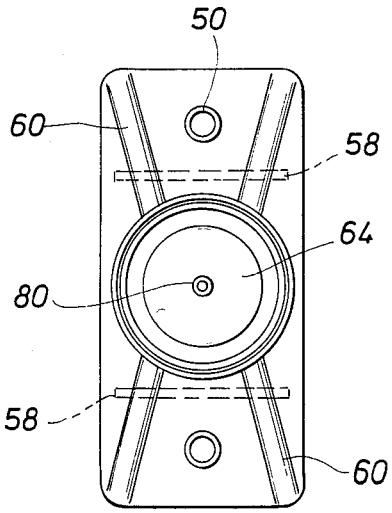
FIG. 4
FIG. 3
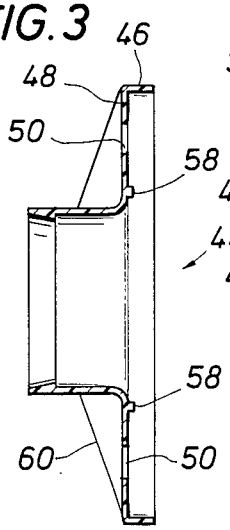
FIG. 2
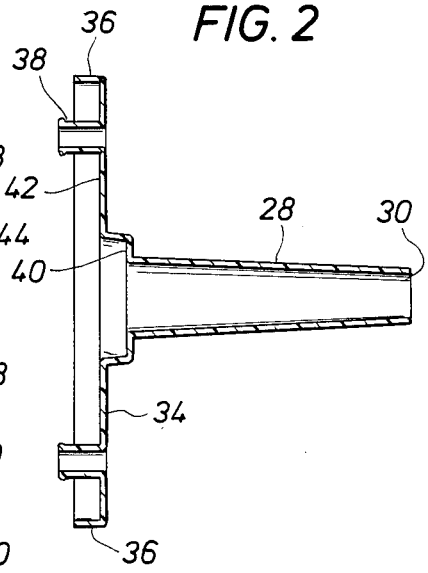
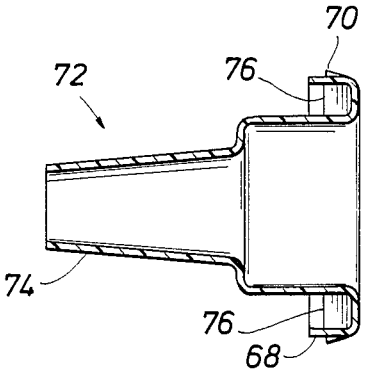
FIG. 5

HERMETICALLY SEALED ANCHOR CONSTRUCTION FOR USE IN POST TENSIONING TENDONS

BACKGROUND OF THE DISCLOSURE

In the fabrication of beams and columns made of cast materials, a common approach is to cast a beam or column which cures to hardened concrete. Concrete is notorious in that it is relatively weak in tension but quite strong in compression. Performance of such a cast member is markedly improved by applying post tensioning, that is applying a compressive load on the cast member after curing. This changes the internal stress so that it is primarily in a compressive state along its full length. Several patents by Howlett set forth various and sundry tensioning devices, representative patents being U.S. Pat. Nos. 3,605,361 or 3,520,032. It is intended that such a tensioning device be placed permanently in a cast member to place a compressive load on the member for the life of the member. This can easily be 20 years, and would not unreasonably be 50 years. There is a measure of concern regarding long term failure modes. The failure mode typically is thought to be attack of the anchor plate, wedges and cable at the wedge. In the ordinary tensioned cast member, an elongate wire, typically a multi-strand woven wire rope, is anchored against a metal plate which bears against the end of the cast member. The wire is relatively small in diameter in comparison with the plate. The plate provides a relatively large bearing area to sustain the axial load applied to the member. Thus, compression is distributed by the anchor plate into the cast member. There is conjecture regarding various and sundry modes of failure. One conjectured mode of failure relates to electrolysis of the metal members. The electrolysis is aggravated by the locale where the tensioning member is located, thereby exposing it to rain and subsequent drying. During a year, the multiple cycles of drying and wetting as a result of rain may create undesirable electrical currents in the near vicinity. One protective approach is more aptly described in the patent of Schupack, U.S. Pat. No. 4,358,844. That disclosure seeks to place a completely surrounding electrical insulator about the anchor plate as a means of preventing the conjectured long term mode of failure primarily involving electrolysis.

The present apparatus is a very desirable protective member which is assembled at the time of fabrication of the post tensioned member to protect the anchor plate at the end of the cable. Thus, it cooperates with a conventional anchor plate which engages a multi-strand wire rope. The anchor plate, circular wedge, and woven cable and the tendon sleeve around the cable are not altered by the incorporation of the present apparatus. This apparatus can be used on appropriate sizing with anchor plates currently in vogue. Moreover, this apparatus is more aptly concerned with hermetic sealing to thereby prevent contact of the metal componets with chemicals or liquids which might be in the vicinity after installation. Corrosion protection is thus obtained by hermetic sealing so that the metal components are covered over and contact with oxygen is thereby minimized. The covering is achieved by constructing a surrounding housing or container which encapsulates the anchor and the other metal components. The housing is then filled, and indeed preferably overfilled with injected grease. The grease is of such viscosity to adhere to the surface continuously and to thereby provide lifetime hermetic sealing. Accordingly, the present apparatus is a structure to receive a charge of hermetic sealants, the preferred form being an oxygen repellent grease. Alternatively, the material can be mixed with an epoxy resin which cures to form a shaped encapsulation around the anchor plate and other metal components.

To have assurance of filling, the present encapsulating apparatus is constructed of parts which fit together very loosely. This assures that the device can be filled to expel most of the air. By visual observation, it is preferably filled and overfilled, the operator observing the excess flow of grease through the seams between the various components of the encapsulation structure. The encapsulation structure includes what might be termed a plastic tray sized and shaped to fit around the anchor plate. It is constructed with an elongate trumpet to extend around the tensioned wire rope and sleeve thereabout. It is conveniently sealed thereagainst with adhesive tape applied at the time of installation. Moreover, the tray is rectangular, fitting around the anchor plate. The anchor plate is then covered over by a mating nesting cover. The cover is sized to fit over the anchor and thereby define an internal cavity. The anchor cover in turn is open at the center. A large circular opening is provided. This exposes the metal components which are on the interior including the circular wedge which grips the cable and holds the cable in a tensioned mode. This access opening permits post tensioning of the cable after the concrete has cured. Moreover, a plug is incorporated which neatly fits within the circular opening left at the cover plate. The plug in turn is equipped with a grease fitting such as a zerk fitting. The zerk fitting is adapted to be connected with a hose fitting from a grease gun so that grease can be forced into the encapsulating structure of the present disclosure, filling the entire cavity with grease and overfilling so that grease is seen by the operator flowing out of the open seams between the structural components. In sum, the present apparatus is a three part construction, the components joining about the metal components of a post tensioning system. The encapsulating apparatus components are convenient to manufacture at low cost in view of the fact that they do not have to fit together snugly; indeed they preferably fit loosely to define surrounding open seams whereby an excess of injected grease flows out of the encapsulation structure. This assures that most oxygen on the inside has been expelled.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 shows the post tensioning anchor encapsulation apparatus of this disclosure, and more particularly sets forth the encapsulation housing which encloses the end of the tensioned cable and anchor plate and further illustrates how grease can be placed fully about the metal members to provide protection;

FIG. 2 is a sectional view through the tray member of the encapsulation structure;

FIG. 3 is a section view through the mating and opposing cover member which nests to the tray member of FIG. 2;

FIG. 4 is a plan view of the apparatus shown in FIG. 1 showing the closer with a circular plug and having a grease fitting therein; and FIG. 5 is a sectional view through an alternate plug wherein the cable is permitted to extend through the plug.

DETAILED DESCRIPTION OF THE PREFERRED EMBODIMENT

Attention is first directed to FIG. 1 of the drawings where the numeral 10 identifies the hermetic sealing encapsulation apparatus of the present disclosure. It is intended to be used with a tensioned member. Perhaps the background relating to assembly of tensioned members will help.

Assume that a post tensioned concrete beam is to be formed utilizing this procedure. The beam is typically formed in a mold or cavity shaped to the outline and configuration desired for the completed product. Moreover, it terminates at two ends. One or more tensioning cables is placed in the form before pouring. They are assembled from elongate woven wire cables. A sleeve is formed about each cable and is representatively shown in FIG. 1 of the drawings. There, the numeral 12 identifies the wire rope. The wire rope is inside a sleeve 14 which extends the full length of the woven wire member. The sleeve is packed with grease which enables cable movement in the sleeve. The sleeve extends up to the anchor plate as will be described. The anchor plate is identified at 16 and generally formed as an elogate rectangular plate. It is a bearing plate to distribute the load to the cast and cured concrete member identified by the numeral 18. The cast member 18 is permitted to cure in the form or mold. At this point, the cable 12 is under zero tension. The anchor plate includes a tapered opening 20. The anchor plate is formed with the central conic opening 20, this opening having a taper conforming with industry standards, typically in the range of about 7°. The cable 12 extends entirely through the opening in the anchor plate. A circular tapered wedge 22 is a split ring. It has an external tapered face which more or less conforms with the tapered hole 20.

After the concrete 18 has cured, a load is pulled on the cable 12 and tension is placed in the cable. The wedge shaped member 22 is then driven into the opening 20. It is driven sufficiently deep that it firmly and snugly wedges against the opening 20 and grips radially around the cable 12. The cable is cut as desired to leave a stub 24. The loading applied by the cable 12 is on the cast member 18 and completely alters the performance of the cast member by virtue of the tensioning applied to the cable resulting in compression applied to the cast member. This is described as post tensioning stress from the use of one or more wire ropes extending through the cast body. While one will suffice for certain size cast members, more can be used to distribute stress across the cast member so that the cast member operates in a desired fashion.

Ordinarily, the metal components including the anchor plate 16, the tapered wedge 22, and the exposed stub 24 are left susceptible to rust or corrosion. It is conceivable that the rust and corrosion acting on the metal components may damage the metal components. In fact, they might ultimately fail. Failure would then release the cable and completely alter the internal stresses in the cast member 18, thereby creating the risk of cast member failure. This catastrophic failure would be extremely dangerous to the safety of bystanders and may also create significant property damage.

The present apparatus is a structure intended to be used with post tensioning devices including the anchor plates. It is particularly advantageous in that it enables a hermetic seal to be prefected around the metal members by covering them over with packing grease. This hermetic sealing system thus minimizes exposure to oxygen and thereby retards or eliminates oxidation. This also excludes undesired gasses or fumes in the atmosphere which might otherwise attack the structure.

Directing attention now to the encapsulation apparatus 10 of the present disclosure, the tray member will be first described. It has a central trumpet 28 which is a tapered elongate member having an end opening at 30. The opening 30 is sized to fit about the cable 12 surrounded by the enclosing sleeve 14. A short piece of tape will be wrapped around the opening at 30 to thereby restrict oxygen circulation along the trumpet. Otherwise, the opening 30 is sized so that it fits close to and almost snug around the sleeve 14. The trumpet 28 defines an interior cavity which is adapted to be filled with grease at the time the device is packed with grease. This permits access to the packing grease in the vicinity underneath the anchor plate 16 and particularly at the point where the cable 12 emerges from the tapered plug 22 within the tapered opening 20 in the anchor plate. The anchor plate is typically a rectangular member having a pair of nail holes therein, one being indicated by the numeral 32. Conveniently, the encapsulation apparatus of the present structure accommodates such nail openings. To this end, it has the form of a generally rectangular tray or bottom 34 and a surrounding outer lip 36. At the appropriate locations where the nail openings are found, there are upstanding hollow sleeves 38 which are located to extend upwardly through the nail holes 32 in the anchor plate. This assures that nail guides are available so that the anchor plate 16 can be nailed to the forms which define the mold in which the cast member 18 is shaped. For aid of clarity, the nail receiving sleeve 38 has been included at the top of FIG. 1 but has been omitted at the bottom of FIG. 1 to show how the anchor plate is fully enclosed. The sleeve 38 is enlarged at the end lip to create a type of snap lock.

Directing attention momemtarily to FIG. 2 of the drawings, the tray shaped member is shown separate from the remaining portions of the structure. The encapsulation apparatus 10 is placed on the tendon by pushing the tendon through the trumpet 28 and thereafter making connection between the tendon and the anchor plate 16. As observed in FIG. 2, there is an internal circular shoulder 40 which supports the central thrust structure of the anchor plate. In addition, there is a planar surface at 42 which contacts against the bottom face of the anchor plate. The anchor plate is generally rectangular and hence, the upturned lip 36 around the periphery stands as tall as the anchor plate. Conveniently, the tray member 34 is made of available plastic materials such as polyethylene, perhaps 30 to 90 mils thick and is typically made opaque.

In FIG. 3 of the drawings, the mating top cover is indicated generally by the numeral 44. It is constructed of a similar plastic material of relatively similar thickness. It is defined by a rectangular protruding lip 46 which is sized to fit loosely within the lip 36. The lip 46 has a height to enable the planar member 48 to fit over the anchor plate 16. So to speak, lip edged cover nests against the opposing and conforming member 34 so that the two together form a housing. The housing is slightly larger than the rectangular anchor plate and the anchor plate is thus enclosed on the interior. A hole 50 is formed at a location suitable to permit the nail receiving sleeve 38 to protrude upwardly, the sleeve standing taller than the two assembled members 34 and 44.

An upstanding circular sleeve 52 is centered in the apparatus so that it will align with the trumpet 28 when the components are joined together. It is upstanding and open at the top. The top rim 54 permits a plug to be placed therein. The rim 54 is adjacent to an internally located shoulder 56. The shoulder defines a downwardly facing undercut which serves as a locking edge. Locking of the circular plug will be described in detail hereinafter in conjunction wiht the casting process. Conveniently, reinforcing ribs 58 are located on the interior and span across the cover 44. These ribs 58 also function to force the anchor 16 into contact with the tray 34 and tray protrusion 40.

FIG. 3 further shows reinforcing gussets 60 which have the form of webs spanning between the upstanding circular sleeve and the cover 44. In the preferred construction, two such gussets are included on each side, there being a total of four as better shown in FIG. 4. There, the reinforcing webs 60 are illustrated to extend at slightly divergent angle approximately towards the four corners of the rectangular shaped encapsulation means 10 so that added reinforcing is available. It will be understood that the encapsulation structure is more of a containment device rather than a load bearing structure. To this end, it is not essential that the device be constructed for undergoing significant loads. However, since it is constructed with a view of being left in place for the lifetime of the cast member 18, easily 20 to 50 years, the added reinforcing assures that the top cannot be destroyed as might occur in the vagaries of installation.

Attention is jointly directed to FIGS. 1 and 4 which both illustrate different views of a plug 64. It is circular as shown in FIG. 4 and sized to fit within the upstanding tubular member 52. It incorporates a central, exposed, circular face 66 which stands above, somewhat in the fashion of a raised cover so that the tendon stub 24 will not bump against the top. The plug 64 is constructed with an upturned lip at 68. The lip 68 is sized to fit snugly in the upstanding tubular member 52. Moreover, it is sized to slide in the rim 54 past the shoulder 56 (FIG. 3). The shoulder 56 is an abrupt discontinuity and serve as a locking surface. To this end, spaced, external tapered wedges 70 (see FIG. 5) are formed around the plug. Perhaps three or four are sufficient to enable the plug 64 to be abutted and held in position as illustrated in the assembly view of FIG. 1.

The top of the plug 64 has an opening form therein and a grease fitting 80 is positioned in the opening. The grease fitting 80 can conveniently be a zerk or Alemite fitting. Alternatively, a simple sleeve can be used and a sized plug such as a small tack can be stabbed into it to close it.

In FIG. 5 of the drawings, a modified plug 72 is illustrated. It is similar in all regards to the plug 64 except that it includes an upstanding trumpet 74 affixed to the top. This permits the trumpet 74 to enclose the tendon extending past the stub 24 where it is otherwise cut in FIG. 1. In some installations, it may be appropriate to further extend the tendon and this construction of a plug can be used in that instance. Moreover, the embodiment 72 includes a reinforcing gusset 76 which is located at perhaps four locations around the plug to reinforce the lip 68.

INSTALLATION WITH AN ANCHOR PLATE

At the time that a cast member is to be formed and as the anchor plate 16 is deployed in the mold or form, the tendon is extended between the forms and the anchor plate is located near the ends. Before the anchor plate is nailed to the forms, the tray member 34 is positioned on the tendon so that it can slide up the tendon and nest against the anchor plate. At this juncture, the anchor plate is loose (relatively speaking) prior to being positioned against the end of the forms. A tray and cover are snapped together around an anchor plate. A removable pocket former 84 is temporarily placed in the cover opening. It has an exterior surface shaping a cavity in the cast material. The formed structure 18 has an end face 82 with a recessed cavity 84. This cavity is defined by the removable pocket former. This cavity leaves the recessed area to enable cable cutting, closure with the plug 64, and packing with grout after the present device is grease packed. So to speak, the pocket former leaves a temporary opening which is later filled to level the endface 82. At this stage, the tapered plug 22 has not been made fast around the tendon. The tendon has not been cut, the tendon being much longer to enable the post tensioning step to be undertaken.

After the concrete has cured in the forms, the pocket former is removed and the tendon is tightened in the customary fashion. The tendon is typically cut to define the stub 24. The anchor plate then supports a broadly distributed load against the cast member. Tension in the cable is then converted into a compressive force acting on the cast member. Moreover, and important to this disclosure, the tray 34 is caught against the cast member 18. This position of the tray 34 prepares it to receive the plug and packing components, not yet installed. When the post tensioning sequence is completed and the cable is cut to define the stub 24, the cover 44 is already in position around the anchor plate 16. The nested components join at the lips 36 and 46 to define a nesting structure. The plug 64 is then inserted in the formed pocket 82. The plug 64 is positioned so that it covers over the stub 24 and the anchor plate 16. The plug may contact the anchor plate as shown in FIG. 1. On the other hand, there may be a gap between the plug 64 and the anchor plate. It is not really critical that a contact be obtained wherein the plug 64 bottoms against the anchor plate. The plug is forced in until the protruding tabs 70 lock against the undercut shoulder 56.

At this time a grease gun hose and suitable fitting is connected into the grease fitting 80. A heavy or viscous grease is forced into the cavities surrounding the anchor plate 16. It is preferably a viscous material which forms a hermetic seal around the metal parts. For instance, the wedge 22 is a circular ring like member having a lengthwise slot along it. This slot permits injected grease to squirt through the tapered opening 20 along the metal cable to fill a portion of the trumpet 28, thereby fully enclosing this portion of the metal components. Moreover, the injected grease is permitted to flow fully around the anchor plate 16 to the outer edges. Grease is injected continuously until it extrudes out around the periphery of the plug 64. The continuous injection of grease is extended to assure that a significant portion of grease oozes out around the plug 64. This serves as an indication that the anchor plate has been surrounded by grease. Grease is injected until the operator is reasonably certain that all the internal cavities have been filled so that the encapsulation means of the present disclosure fully surrounds the metal members with a hermetic seal in the form of grease. Heavy grease is used so that, over a period of time, it does not leak or otherwise flow away from the metal members which are then protected against rust and corrosion. If desired, the grease could be mixed with some kind of jelling or hardening agent such as an epoxy resin. The plastic parts join at the lips 36 and 46 and also the shoulder 56; these regions can be caulked with silicon packing or the like as an aid to installation.

The mode of protection applied to the metal members is primarily hermetic sealing. To this end, it is not important that the encapsulation means of the present disclosure provide a perfect seal. Indeed, a perfect seal is expensive and somewhat difficult to obtain. Rather, the encapsulation means of the present disclosure functions as a container or housing which holds an adequate measure of grease packed around the metal members so that exposure to oxygen is minimized. After the grease gun has been used and disconnected, the opening 80 can be plugged as, for instance, by positioning a plug, tack or nail in the hole (See FIG. 3). Alternatively, self closing grease fittings such as an Alamite fitting can be used. To the extent that excessive grease oozes between the fitted parts of the encapsulation means 10, it can be wiped away, thereby leaving a relatively clean installation which will then protect the metal members for the life of the cast members 18.

The alternate form of plug can be used. If this is needed the grease gun can be used to simply fill all the regions of the members 34 and 44 without the plug, the plug 72 being moved up the tendon. Thereafter, the plug 74 is forced along the tendon and seated in the encapsulation means and the remaining regions on the interior of the plug 72 are then filled with grease. Grease is ideally placed in the trumpet 74 also.

While the foregoing is directed to the preferred embodiment, the scope is determined by claims which follow:

What is claimed is:

1. A protective apparatus for use with an anchor plate on a tendon wherein the tendon and anchor plate are installed on a cast or molded structure, the apparatus comprising encapsulation means surrounding the anchor plate and the end of said tendon exposed to atmosphere and having an interior space adapted to receive hermetic sealing viscous material protecting the anchor plate and tendon, said encapsulation means comprises upper and lower members, said members having cooperative peripheral lips for joining together in a loose fit, the fit being sufficient to enable grease to be injected thereinto and to flow between the lips to assure complete filling with the hermetic sealing material.

2. The apparatus of claim 1 wherein said encapsulation means comprises a tray member having (a) a profile defined by the size and shape of the anchor plate and adapted to extend thereabout;
(b) an upstanding lip around a peripheral edge of the plate;
(c) a central trumpet adapted to align with and extend along a tendon; and
(d) a central planar portion adapted to extend along the back face of the anchor plate.

3. The apparatus of claim 1 including a cover member in said encapsulation means and having (a) a planar member having a size and shape to extend beyond the peripheral edge of an anchor plate;
(b) a protruding lip joined to said planar member to extend over and around the peripheral edges of the anchor plate;
(c) an upstanding cylindrical member adapted to fit about the stub end of a cut tendon;
(d) appropriate nail holes located therein to align with nail holes in the anchor plate; and
(e) a wall thickness to hold the sealing material therein.

4. The apparatus of claim 1 wherein said encapsulation means comprises first and second members which nest together to define loosely joined components having a gap therebetween, said gap being sufficient that a hermetic sealing material placed on the interior thereof oozes through said gap.

5. The apparatus of claim 1 including upper and lower mating members defining an interior space about the anchor plate and having (a) upper and lower engaging lips holding said members together;
(b) fluid fitting means opening into the interior of said members for admitting the viscous sealing material thereto; and
(c) opening means from the interior of said members enabling excess viscous material to flow therethrough to indicate viscous sealing material overflow.

6. The apparatus of claim 5 wherein said fluid fitting means is a grease fitting on a removable plug joined to said members.

7. The apparatus of claim 6 wherein said plug fits in a conforming opening in one of said members and including means locking said plug in said opening.

8. The apparatus of claim 1 wherein said encapsulation means comprises:

(a) a tray nesting about the anchor plate;
(b) a cover nesting with said tray such that said tray and cover enclose the anchor plate; and
(c) an elongate and tapering trumpet extending along the tendon connecting to the anchor plate, said trumpet joining to said encapsulation means.

9. A method of protecting a metal anchor plate and tendon from corrosion or oxidation damage on a cast member comprising the steps of:

(a) placing a tray about a metal anchor plate prior to post tensioning of a tendon;
(b) thereafter joining a releasable cover to the tray to form a fluid containing housing; and
(c) filling the fluid containing housing to overflow with viscous sealant from the housing as an indication of adequate filling and to exclude oxygen from contact with the metal surfaces wherein the housing is filled until overflow occurs from between the joined cover and tray.

10. The method of claim 9 further including the step of joining the cover & tray at matching, nesting lips frictionally held together.

11. The method of claim 10 including the step of joining lips together by nesting the tray and cover together surrounding the anchor plate.

12. The method of claim 11 further including the step of defining an opening in the cover prior to use, and placing a plug in said opening after use to close the opening wherein the opening permits packing of the viscous material around the anchor plate.

13. The method of claim 12 including the step of releasably joining the plug in the opening.

* * * * *